US010399656B2

(12) United States Patent
Fukuchi et al.

(10) Patent No.: US 10,399,656 B2
(45) Date of Patent: Sep. 3, 2019

(54) REMOTE CONTROL SYSTEM OF BOAT PROPULSION DEVICE

(71) Applicant: SUZUKI MOTOR CORPORATION, Hamamatsu-shi, Shizuoka (JP)

(72) Inventors: Satoru Fukuchi, Hamamatsu (JP); Keisuke Daikoku, Hamamatsu (JP)

(73) Assignee: SUZUKI MOTOR CORPORATION, Hamamatsu-shi (JP)

( * ) Notice: Subject to any disclaimer, the term of this patent is extended or adjusted under 35 U.S.C. 154(b) by 0 days.

(21) Appl. No.: 15/969,494

(22) Filed: May 2, 2018

(65) Prior Publication Data

US 2018/0354597 A1 Dec. 13, 2018

(51) Int. Cl.

| | |
|---|---|
| ***B63H 23/24*** | (2006.01) |
| ***G08B 6/00*** | (2006.01) |
| ***B63H 21/21*** | (2006.01) |

(52) U.S. Cl.

CPC ..... *B63H 23/24* (2013.01); *B63H 21/213* (2013.01); *G08B 6/00* (2013.01); *B63H 2021/216* (2013.01)

(58) Field of Classification Search

CPC ..... B63H 23/24; B63H 20/00; B63H 21/213; B63H 2021/216

See application file for complete search history.

(56) References Cited

U.S. PATENT DOCUMENTS

2007/0093147 A1* 4/2007 Mizutani ..... B63H 20/00 440/1

FOREIGN PATENT DOCUMENTS

JP 2007-297004 A 11/2007

* cited by examiner

*Primary Examiner* — Hongmin Fan

(74) *Attorney, Agent, or Firm* — Troutman Sanders LLP

(57) ABSTRACT

A remote control system of outboard motor configured to operate the outboard motor through communications with the outboard motor. The remote control system includes an operating lever operated by a boat operator and a motor unit configured to give reactive force against the operation of the operating lever. The motor unit is configured to give the reactive force according to an operating direction of the operating lever and at least any one of an operating speed and a lever position of the operating lever.

10 Claims, 7 Drawing Sheets

REMOTE CONTROL SYSTEM OF BOAT PROPULSION DEVICE

CROSS-REFERENCE TO RELATED APPLICATIONS

This application is based upon and claims the benefit of priority of the prior Japanese Patent Application No. 2017-114605, filed on Jun. 9, 2017, the entire contents of which are incorporated herein by reference.

BACKGROUND OF THE INVENTION

Field of the Invention

The present invention relates to a remote control system of boat propulsion device. Especially, the present invention is preferably used as a remote control system operating a boat propulsion device through communications.

Description of the Related Art

Recently, as a remote control system of boat propulsion device, for example, a remote control system of by-wired system in which an operating lever and a boat propulsion device are not mechanically coupled with a cable or a similar member but are electrically connected and operated through communications has been proposed. With the remote control system operating through communications, the operating lever unintentionally moves easily.

Patent Document 1 discloses a remote control that includes a housing to which a driving shaft of an operating lever is rotatably mounted. The driving shaft of the operating lever housed and disposed in the housing includes an integrated rotating body. The rotating body has a tapered surface on the outer periphery, and a braking surface of a brake shoe is pressed to the tapered surface. Braking force between the tapered surface and the braking surface can be adjusted with an adjustment mechanism.

Patent Document 1: Japanese Laid-open Patent Publication No. 2007-297004

The remote control of Patent Document 1 can give a resistance by the braking force between the tapered surface and the braking surface; therefore, an unintentional movement due to an influence of external force such as a vibration can be prevented. However, this has a problem that since the constant resistance is always given to the operating lever, a magnitude of reactive force against the operating state of the operating lever cannot be freely adjusted.

SUMMARY OF THE INVENTION

The present invention has been made to solve the above-described problem, and an object of the present invention is to ensure freely adjusting a magnitude of reactive force against an operation state of an operating lever.

A remote control system of boat propulsion device according to the present invention is configured to operate the boat propulsion device through communications with the boat propulsion device. The remote control system includes an operating lever and a reactive force giving unit. The operating lever is operated by a boat operator. The reactive force giving unit is configured to give reactive force against the operation of the operating lever. The reactive force giving unit is configured to give the reactive force according to an operating direction of the operating lever and at least any one of an operating speed and a lever position of the operating lever.

DETAILED DESCRIPTION OF THE PREFERRED EMBODIMENTS

An embodiment according to the present invention is a remote control system 60 of an outboard motor 10 configured to operate the outboard motor 10 through communications with the outboard motor 10. The remote control system 60 includes an operating lever 71 operated by a boat operator and a motor unit 76 configured to give reactive force against the operation of the operating lever 71. The motor unit 76 is configured to give the reactive force according to an operating direction of the operating lever 71 and at least any one of an operating speed and a lever position of the operating lever 71. With the remote control system 60 of the outboard motor 10 of this embodiment, the motor unit 76 controls a magnitude of the given reactive force against the operation of the operating lever 71. Accordingly, the reactive force against the operation of the operating lever 71 can be freely adjusted.

First Example

The following describes examples of this embodiment with reference to the attached drawings.

Figure 1:
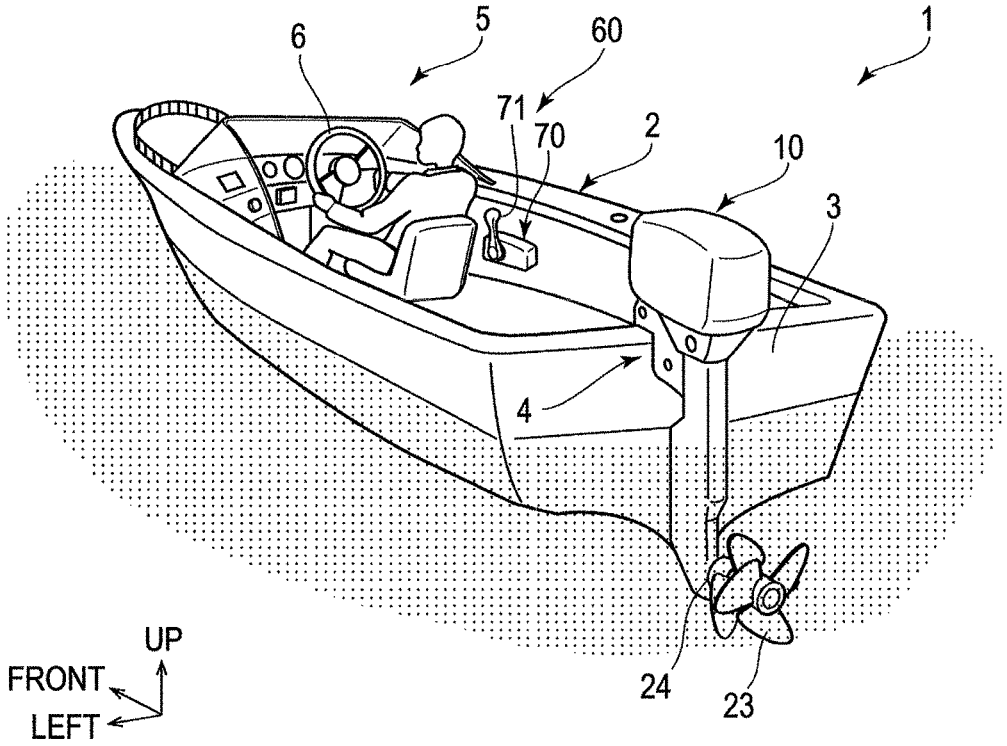
FIG. 1 is a perspective view viewing a boat from obliquely rearward.

FIG. 1 is a perspective view viewing a boat 1 from obliquely rearward. The following drawings indicate the front side of the boat 1 by a "front" arrow and define the opposite as the rear side as necessary. The left side of the boat 1 is indicated by a "left" arrow and the opposite is defined as the right. The upper side of the boat 1 is indicated by an "up" arrow and the opposite is defined as the lower side. The following defines the front side as a boat 1 traveling direction.

As illustrated in FIG. 1, in the boat 1, the outboard motor 10 as the boat propulsion device is mounted to a transom board 3, which is positioned at the rear of a boat body 2, via a bracket device 4.

A wheelhouse 5 is disposed at the front of the boat body 2. The wheelhouse 5 includes a steering handlebar 6, and, for example, a remote control device 70 constituting the remote control system 60 is disposed at the lateral side.

First, the following describes the outboard motor 10.

Figure 2:
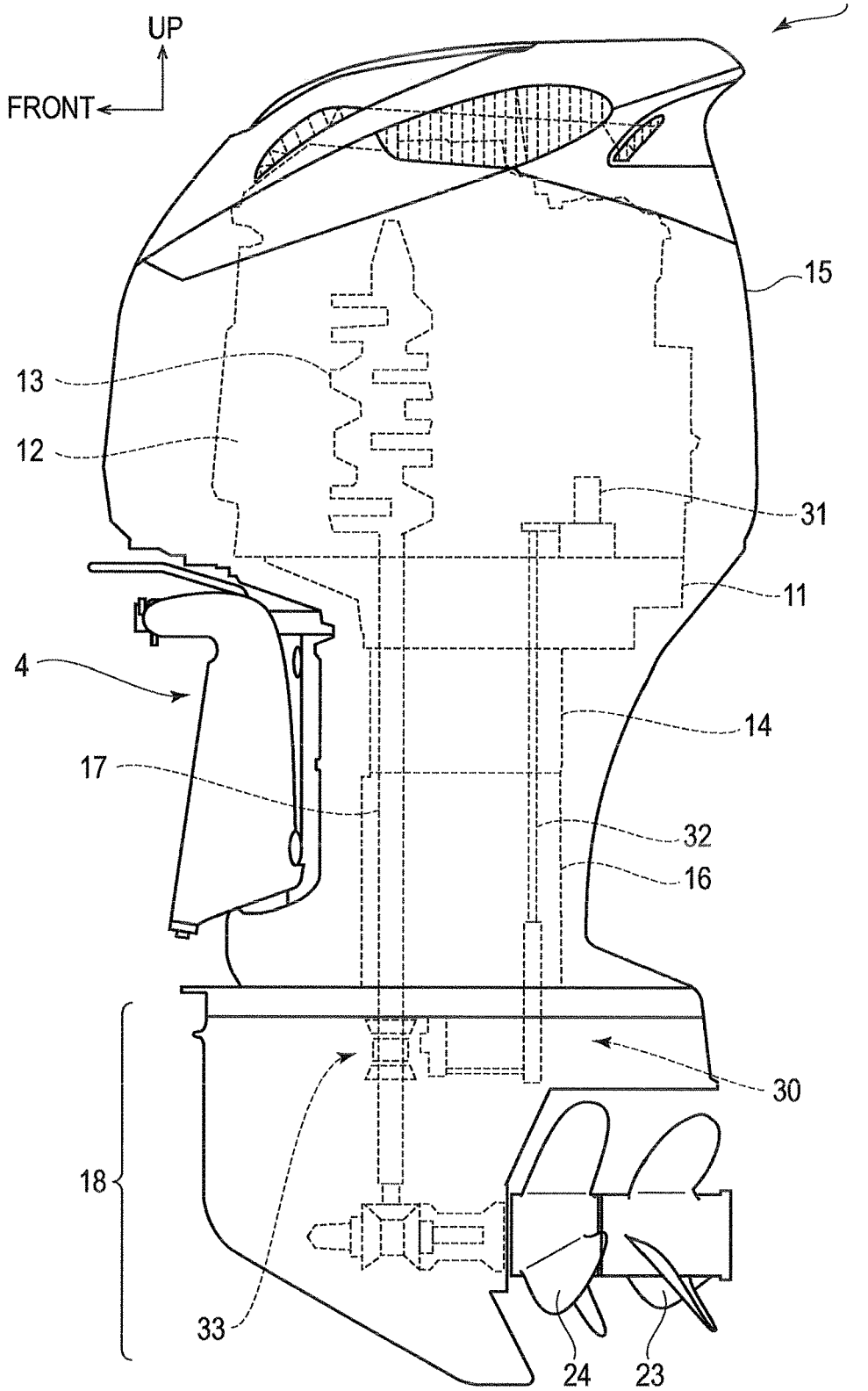
FIG. 2 is a left side view illustrating a configuration of an outboard motor.

FIG. 2 is a left side view illustrating one example of the configuration of the outboard motor 10.

As illustrated in FIG. 2, the outboard motor 10 includes an engine holder 11, and an engine 12 is installed at the upper side of the engine holder 11. The engine 12 is, for example, a water-cooled, four-cycle, four-cylinder engine, and is a vertical (longitudinal) type where a crankshaft 13 is approximately vertically disposed.

An oil pan 14 is disposed below the engine holder 11. An engine cover 15 covers peripheral areas of the engine 12, the engine holder 11, and the oil pan 14 of the outboard motor 10. A drive shaft housing 16 is disposed at the lower portion of the oil pan 14. A drive shaft 17 is approximately vertically disposed at the inside of the drive shaft housing 16. The upper end portion of the drive shaft 17 is coupled to the lower end portion of the crankshaft 13, and the lower end portion extends up to an inside of a propulsion unit 18 (a gear case), which is disposed at the lower side of the drive shaft housing 16.

Figure 3:
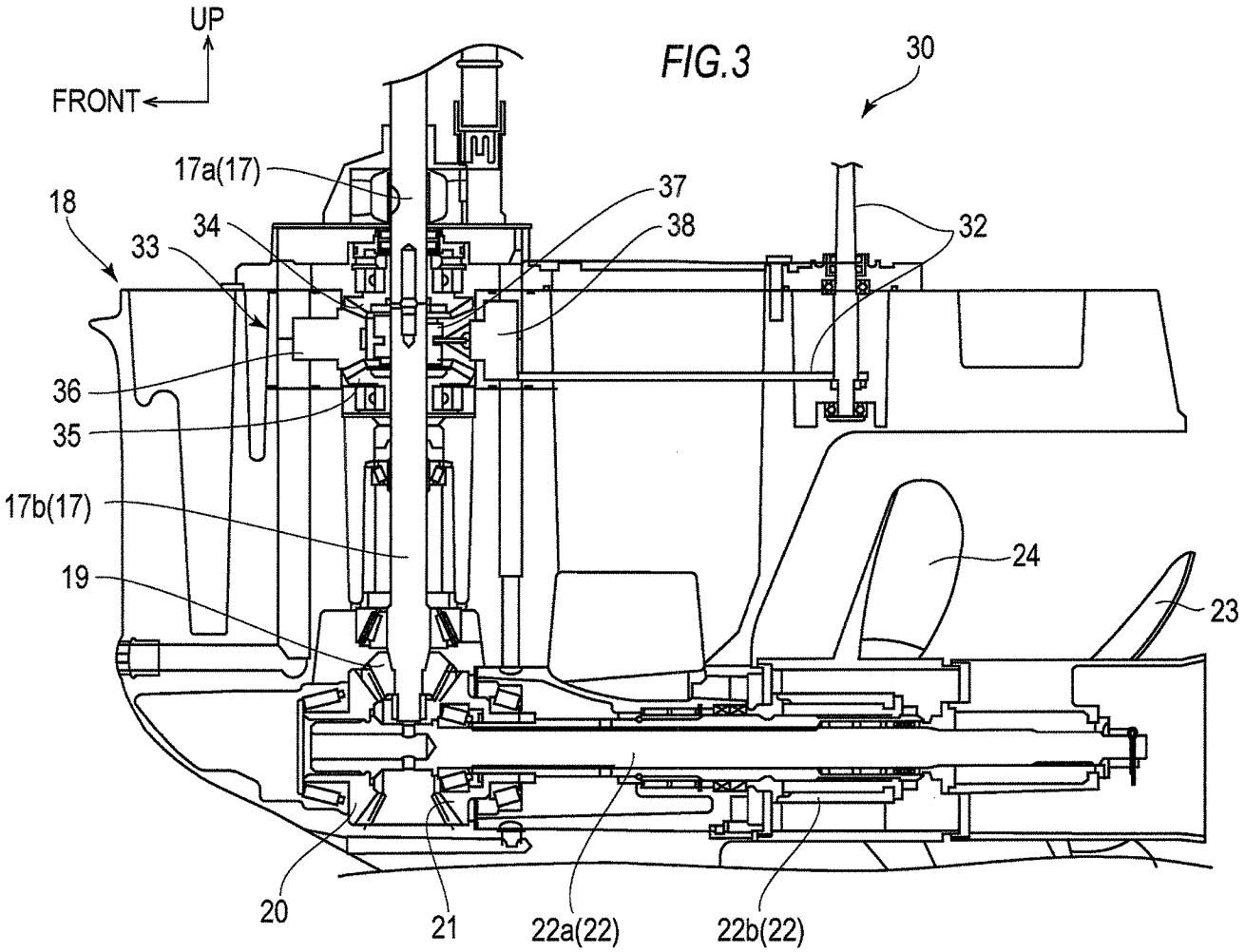
FIG. 3 is a drawing illustrating an inner configuration of a propulsion unit.

FIG. 3 is a drawing illustrating one example of the inner configuration of the propulsion unit 18.

As illustrated in FIG. 3, the drive shaft 17 includes a first input shaft 17*a* and a second input shaft 17*b*. A pinion gear 19 is mounted to the lower end of the second input shaft 17*b* of the drive shaft 17. The pinion gear 19 meshes with a front-side gear 20 and a rear-side gear 21. To the front-side gear 20 and the rear-side gear 21, a propeller shaft 22 is mounted. The propeller shaft 22 includes coaxially-disposed inner shaft 22*a* and outer shaft 22*b*. Here, the inner shaft 22*a* is mounted to the front-side gear 20 and the outer shaft 22*b* is mounted to the rear-side gear 21. A rear-side propeller 23 is mounted to the rear end of the inner shaft 22*a* and a front-side propeller 24 is mounted to the rear end of the outer shaft 22*b*.

The rotation of the crankshaft 13 is transmitted from the drive shaft 17 to the pinion gear 19 and then is transmitted to both the front-side gear 2U and the rear-side gear 21 meshing with the pinion gear 19. Accordingly, the front-side gear 20 and the rear-side gear 21 rotate in directions opposite to one another. The rotation transmitted to the front-side gear 20 is transmitted to the rear-side propeller 23 via the inner shaft 22*a*. Additionally, the rotation transmitted to the rear-side gear 21 is transmitted to the front-side propeller 24 via the outer shaft 22*b*. That is, the rear-side propeller 23 and the front-side propeller 24 are counterrotating propellers rotating in the directions opposite to one another.

The outboard motor 10 includes a shift device 30. The shift device 30 includes an electric actuator for shift 31 (see FIG. 2), a shift transmission mechanism 32, and a forward-reverse movement shift mechanism 33. The electric actuator for shift 31 is disposed in the engine cover 15 and driven according to an instruction from the remote control device 70. The shift transmission mechanism 32 transmits driving force from the electric actuator for shift 31 to the forward-reverse movement shift mechanism 33.

The forward-reverse movement shift mechanism 33 switches a shift position by the driving force from the electric actuator for shift 31. As illustrated in FIG. 3, the forward-reverse movement shift mechanism 33 includes an upper gear 34, which rotates integrally with the first input shaft 17*a*, a lower gear 35, which rotates reversely to the upper gear 34, an intermediate gear 36, which meshes with the upper gear 34 and the lower gear 35, a dog clutch 37, and a clutch actuation mechanism 38. The dog clutch 37 is supported so as to rotate integrally with the second input shaft 17*b* and is vertically reciprocable along the second input shaft 17*b*. The clutch actuation mechanism 38 transforms the driving force from the electric actuator for shift 31 into the vertical movement of the dog clutch 37.

By the upper movement of the dog clutch 37 by the clutch actuation mechanism 38, the dog clutch 37 engages with the upper gear 34. In this case, the rotation of the first input shaft 17*a* is transmitted to the second input shaft 17*b* from the upper gear 34 through the dog clutch 37. Accordingly, since the second input shaft 17*b* rotates in the direction identical to the first input shaft 17*a*, the shift device 30 can switch the shift position to the forward movement via the forward-reverse movement shift mechanism 33.

Additionally, by the lower movement of the dog clutch 37 by the clutch actuation mechanism 38, the dog clutch 37 engages with the lower gear 35. In this case, the rotation of the first input shaft 17*a* is transmitted from the upper gear 34 to the second input shaft 17*b* through the intermediate gear 36, the lower gear 35, and the dog clutch 37. Accordingly, since the second input shaft 17*b* rotates in the direction opposite to the first input shaft 17*a*, the shift device 30 can switch the shift position to the reverse movement via the forward-reverse movement shift mechanism 33.

The movement of the dog clutch 37 to the center position at which the dog clutch 37 engages with neither the upper gear 34 nor the lower gear 35 by the clutch actuation mechanism 38 cuts off the rotation of the first input shaft 17*a* without transmission to the second input shaft 17*b*. Accordingly, the shift device 30 can switch the shift position to neutral via the forward-reverse movement shift mechanism 33.

The following describes a configuration related to the control in the outboard motor 10.

Figure 4:
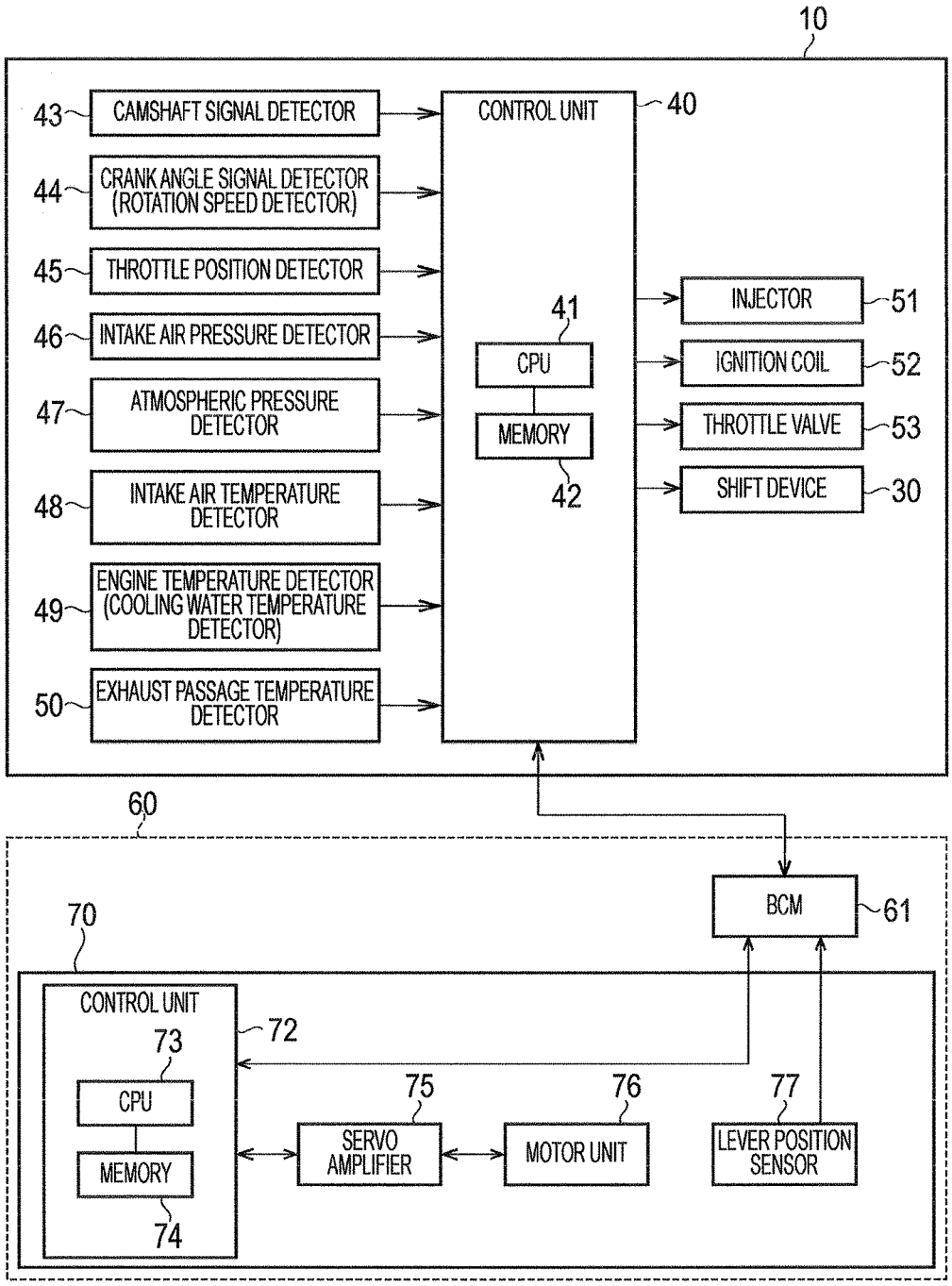
FIG. 4 is a block diagram illustrating configurations of the outboard motor and a remote control system.

FIG. 4 is a block diagram illustrating one example of the configurations of the outboard motor 10 and the remote control system 60.

A control unit 40 controls the entire outboard motor 10. As the control unit 40, for example, an Electronic Control Unit (ECU) is used. The control unit 40 is constituted including a CPU 41, a memory 42, and a similar device.

The CPU 41 executes a program stored in the memory 42 to control the entire outboard motor 10 based on a signal output from, for example, various detectors. The memory 42 stores the program executed by the CPU 41, an initial value when the CPU 41 controls the respective devices, or similar data.

The signal is input to the control unit 40 from various detectors or a similar device inside and outside the outboard motor 10.

Specifically, a camshaft signal detector 43 outputs a signal of a camshaft (a cam angle signal) (not illustrated) of the engine 12. A crank angle signal detector (a rotation speed detector) 44 outputs a rotation speed signal of the crankshaft 13. A throttle position detector 45 outputs a signal according to a throttle position of a throttle valve 53. An intake air pressure detector 46 is disposed at an intake air pipe to output a signal of intake air pressure in the intake air pipe. An atmospheric pressure detector 47 outputs a signal of atmospheric pressure. An intake air temperature detector 48, an engine temperature detector 49 (a cooling water temperature detector), and an exhaust passage temperature detector 50 output signals of a temperature of intake air, a temperature of the engine 12 (a cooling water temperature), and a temperature of an exhaust passage, respectively. The remote control system 60 outputs the signal of the throttle position and the signal of the shift position.

The control unit 40 outputs and controls the signals to the various devices in the outboard motor 10.

Specifically, the control unit 40 controls an injector 51 so as to be an optimal fuel injection timing and amount of injection according to the operating state of the engine 12 and controls an ignition timing of an ignition coil 52. Additionally, the control unit 40 changes the throttle position of the throttle valve 53 based on the signal of the throttle position and the signal of the shift position output from the remote control system 60 to control propulsion of the outboard motor 10 and switch the shift position via the shift device 30.

The following describes the remote control system 60.

The remote control system 60 includes a Boat Control Module (BCM) 61 and the remote control device 70.

The BCM 61 is coupled to the outboard motor 10 and the remote control device 10. The BCM 61 receives the signal of the throttle position and the signal of the shift position from the remote control device 70 and transmits the signals to the control unit 40 in the outboard motor 10. Additionally, the BCM 61 receives information of the operating state of the outboard motor 10 and transmits the information to the remote control device 70. With the plurality of outboard motors 10 and the plurality of remote control devices 70, the BCM 61 organizes and aggregates the information transmitted and received between the outboard motors 10 and the remote control devices 70. The BCM 61 may be omitted, and when the BCM 61 is omitted, the outboard motor 10 and the remote control device 70 can be configured so as to transmit and receive the information between them.

The remote control device 70 is a device that remotely operates the outboard motor 10 by a boat operator using the operating lever 71.

First, the following describes a configuration related to the control in the remote control device 70. The remote control device 70 of this example is configured so as to give reactive force against the operation of the operating lever 71 based on the operating state of the operating lever 71.

The remote control device 70 includes, for example, a control unit 72, a servo amplifier 75, a motor unit 76, and a lever position sensor 77.

The control unit 72 controls a magnitude of the reactive force given by the motor unit 76. The control unit 72 is constituted including a CPU 73, a memory 74, and a similar device.

The CPU 73 executes a program stored in the memory 74 to control the magnitude of the reactive force given by the motor unit 76 via the servo amplifier 75. The memory 74 stores the program executed by the CPU 73.

The servo amplifier 75 receives the information of the operating state of the operating lever 71 received from the motor unit 76 and transmits the information to the control unit 72. Additionally, the servo amplifier 75 drives the motor unit 76 based on the information of the reactive force given to the operating lever 71 received from the control unit 72.

The motor unit 76 turns according to the operation of the operating lever 71 to transmit the information of the operating state to the servo amplifier 75. Additionally, the motor unit 76 is driven based on the instruction of the servo amplifier 75 to give the reactive force against the operating lever 71.

The lever position sensor 77 detects the position of the operating lever 71. The lever position sensor 77 of this example transmits the information of the detected position of the operating lever 71 to the outboard motor 10 via the BCM 61 without transmission to the control unit 72.

The following describes a mechanical configuration in the remote control device 70. Like reference numerals designate identical components to the remote control device 70 in FIG. 4, and therefore such elements will not be further elaborated here.

Figure 5A:
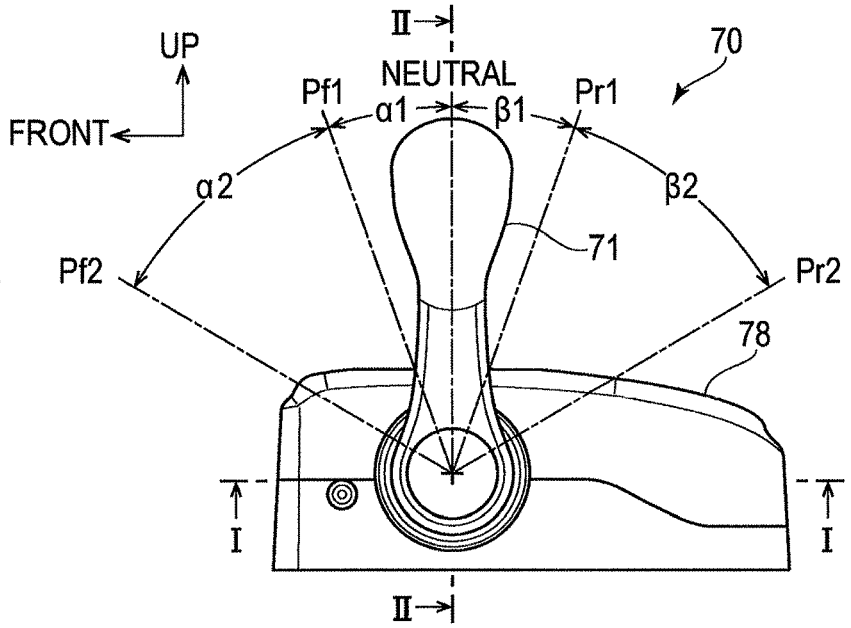
FIGS. 5A to 5C are drawings illustrating a configuration of a remote control device.
Figure 5B:
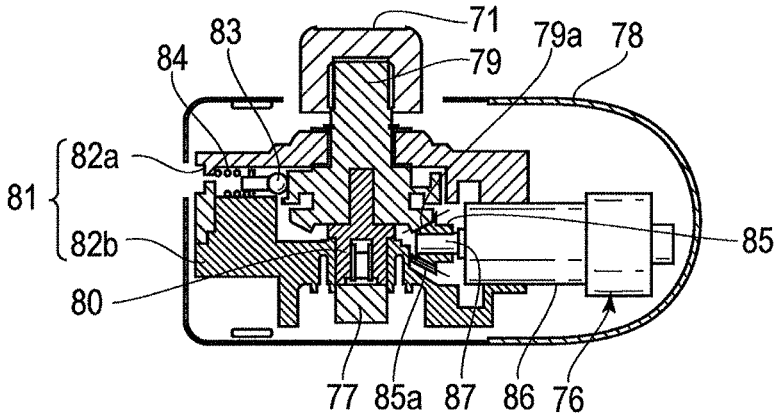
Figure 5C:
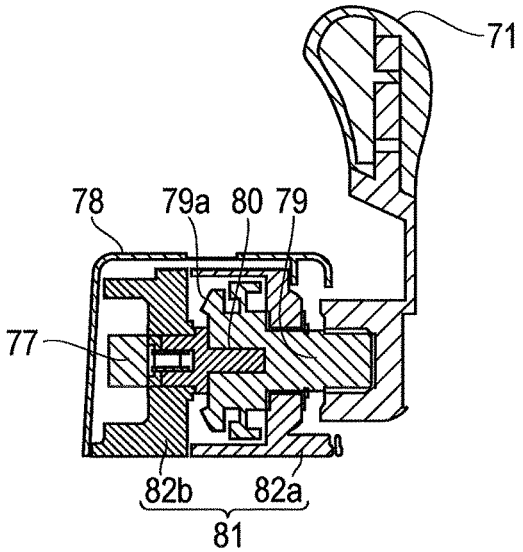

FIGS. 5A to 5C are drawings illustrating one example of the configuration of the remote control device 70.

Specifically, FIG. 5A illustrates a side view of the remote control device 70, FIG. 5B is a cross-sectional view taken along a line I-I, and FIG. 5C is a cross-sectional view taken along a line II-II.

The remote control device 70 includes, for example, the operating lever 71, a cover 78, a shaft member 79, a coupling member 80, the lever position sensor 77, a supporting member 81, a transmitting member 85, and the motor unit 76.

The operating lever 71 is a lever for the boat operator to perform the operation to switch the shift position and the operation to change the throttle position. The operation to change the throttle position is equivalent to an operation of changing a throttle opening of the throttle valve 53 and changing the propulsion of the outboard motor 10.

As illustrated in FIG. 5A, the operating lever 71 can turn a region from a position of Pf2 to a position of Pr2 where the neutral position is located between the positions. Here, with the operating lever 71 at the neutral position, this operation is an operation to switch the shift position to the neutral.

When the boat operator operates the operating lever 71 from the neutral position to a position of Pf1 through a turning region $\alpha$1, this operation is an operation to switch the shift position to the forward movement. Further, when the boat operator operates the operating lever 71 to a turning region $\alpha$2 from the position of Pf1 to the position of Pf2, this operation is an operation to change the throttle position with the shift position in the state of the forward movement. As the operating lever 71 is at the front side in the turning region $\alpha$2, the throttle position of the throttle valve 53 becomes large, becoming an operation to move up the propulsion in the forward movement of the outboard motor 10.

When the boat operator operates the operating lever 71 from the neutral position to a position of Pr1 through a turning region $\beta$1, the operation is an operation to switch the shift position to the reverse movement. When the boat operator operates the operating lever 71 to a turning region $\beta$2 from the position of Pr1 to the position of Pr2, the operation is an operation to change the throttle position with the shift position in the state of the reverse movement. As the operating lever 71 is at the rear side in a turning region $\beta$2, the throttle position of the throttle valve 53 becomes large, becoming an operation to move up the propulsion in the reverse movement of the outboard motor 10.

The cover 78 covers the inside of the remote control device 70 to protect the remote control device 70. The shaft member 79 is coupled to the operating lever 71 and turns integrally with the operating lever 71. To the shaft member 79, a bevel gear 79*a* is integrally combined. The coupling member 80 is coupled to the shaft member 79 and turns integrally with the shaft member 79. The lever position sensor 77 detects the position of the operating lever 71 via the coupling member 80 and the shaft member 79. The lever position sensor 77 transmits the information of the detected position of the operating lever 71 to the control unit 40 in the outboard motor 10 via the BCM 61. The control unit 40 in the outboard motor 10 switches the shift position to the neutral with the operating lever 71 at the neutral position, switches the shift position to the forward movement with the operating lever 71 at the position of Pf1 and in the turning region α2, and switches the shift position to the reverse movement with the operating lever 71 at the position of Pr1 and in the turning region β2. Additionally, with the operating lever 71 in the turning region α2 and the turning region β2, the control unit 40 changes the throttle position according to the position in the turning region α2 and the turning region β2 to control the propulsion of the outboard motor 10.

The supporting member 81 includes a first supporting member 82*a* and a second supporting member 82*b*. The first supporting member 82*a* turnably supports the shaft member 79. The second supporting member 82*b* supports the lever position sensor 77 to turnably support the coupling member 80. The shaft member 79 has a groove (not illustrated) on the outer peripheral surface and a sphere 83 is sunk into the groove biased by a spring 84. The groove is formed such that the sphere 83 sinks into the groove corresponding to the operating lever 71 at the neutral and the positions of Pf1 and Pr1. Accordingly, when the operating lever 71 is turned, the sphere 83 sinks into the groove at the neutral and the positions of Pf1 and Pr1, thus restricting the turning of the operating lever 71 to some extent. Advancing and retreating a screw (not illustrated) ensures adjustment of the biasing force from the spring 84.

The transmitting member 85 is integrally combined with a bevel gear 85*a* meshing with the bevel gear 79*a* of the shaft member 79. The number of teeth of the bevel gear 85*a* is less than the number of teeth of the bevel gear 79*a* and the turning is accelerated from the bevel gear 79*a* to the bevel gear 85*a*.

The motor unit 76 functions as a reactive force giving unit giving the reactive force against the operation of the operating lever 71. With the motor unit 76, a reduction gear 86 is integrally combined. A shaft 87 of the motor unit 76 turns integrally with the transmitting member 85. Accordingly, turning the operating lever 71 turns the motor unit 76 via the bevel gear 79*a* of the shaft member 79, the bevel gear 85*a* of the transmitting member 85, and the reduction gear 86. Conversely, turning the motor unit 76 can generate the reactive force against the operating lever 71 via the reduction gear 86, the bevel gear 85*a* of the transmitting member 85, and the bevel gear 79*a* of the shaft member 79. Here, the reactive force means a force given in the direction opposite to the operating direction of the operating lever 71.

The motor unit 76 of this example is a servo motor, and, for example, a brushless DC motor is applicable. The brushless DC motor includes an angle detector to detect a rotor angle to switch a current by performing switching according to a rotor angle instead of brush. As the angle detector, for example, a Hall element is applicable. Here, since the motor unit 76 turns according to the turning of the operating lever 71, detecting the rotor angle of the motor unit 76 by the use of the angle detector built into the motor unit 76 ensures the detection of the position of the operating lever 71.

The control unit 72 in the remote control device 70 always continues obtaining the position of the operating lever 71 using the motor unit 76, thereby ensuring obtaining the operating state of the operating lever 71. Here, the operating state of the operating lever 71 includes the operating direction of the operating lever 71 and at least any one of the operating angle (the lever position) and the operating speed. The operating direction of the operating lever 71 means the direction that the operating lever 71 turns, any of directions of the front side (the forward movement side) or the rear side (the reverse movement side) in FIG. 5A. Further, the lever position of the operating lever 71 means the moving position of the operating lever 71 from a reference position and is equivalent to the operating angle when the operating lever 71 turns in FIG. 5A. The operating speed of the operating lever 71 means the speed when the operating lever 71 moves and is equivalent to the angular speed when the operating lever 71 turns in FIG. 5A.

The turning of the operating lever 71 is accelerated during transmission from the bevel gear 79*a* to the bevel gear 85*a* and is further accelerated via the reduction gear 86; therefore, the motor unit 76 can accurately detect the position of the operating lever 71 based on the accelerated turning. Thus, the control unit 72 in the remote control device 70 can obtain the operating state of the operating lever 71 without the use of the lever position sensor 77.

The following specifically describes a method of controlling the reactive force given against the operation of the operating lever 71 by the motor unit 76 based on the operating state of the operating lever 71 by the control unit 72 in the remote control device 70.

Figure 6:
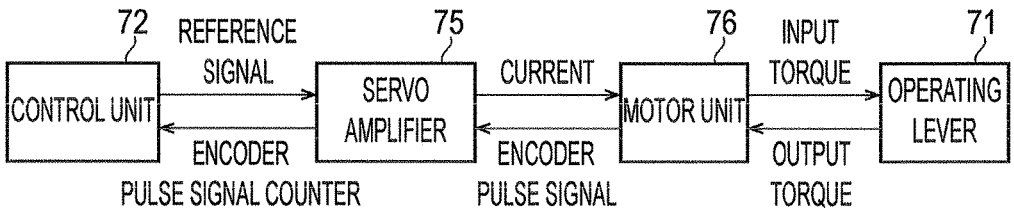
FIG. 6 is a drawing illustrating a flow of control by the remote control device.

FIG. 6 is a drawing illustrating one example of a flow of control by the remote control device 70.

First, the turning of the operating lever 71 is output to the motor unit 76 as a torque. The motor unit 76 outputs a pulse signal to the servo amplifier 75 using the built-in angle detector and an encoder. The servo amplifier 75 counts the pulse signal using the built-in encoder and outputs the counted signal or similar data to the control unit 72. The control unit 72 calculates the operating direction of the operating lever 71 and at least any one of the operating angle (the lever position) and the operating speed based on the counted signal or similar data to obtain the operating state of the operating lever 71.

The control unit 72 determines the reactive force given against the operation of the operating lever 71 based on the obtained operating state of the operating lever 71, here, the driving direction and the driving force of the motor unit 76. Specifically, the control unit 72 drives the motor unit 76 in the direction of causing the operating lever 71 to turn to the side opposite to the operating direction of the operating lever 71. Additionally, the control unit 12 determines the driving force of the motor unit 76 such that the reactive force given against the operation of the operating lever 71 becomes large as the operating angle (the lever position) of the operating lever 71 becomes large or the operating speed becomes large. Such control by the control unit 72 is referred to as a proportional derivative. The control unit 72 can achieve the control of the reactive force through execution of the program stored in the memory 74.

The control unit 72 outputs a reference signal based on the determined driving direction and driving force of the motor unit 76 to the servo amplifier 75. The servo amplifier 75 outputs the current to the motor unit 76 based on the reference signal output from the control unit 72. The motor unit 76 is driven according to the current output from the servo amplifier 75, thus giving the reactive force as the torque against the operation of the operating lever 71.

The following specifically describes one example of a property of the reactive force according to the operating state of the operating lever 71.

Figure 7:
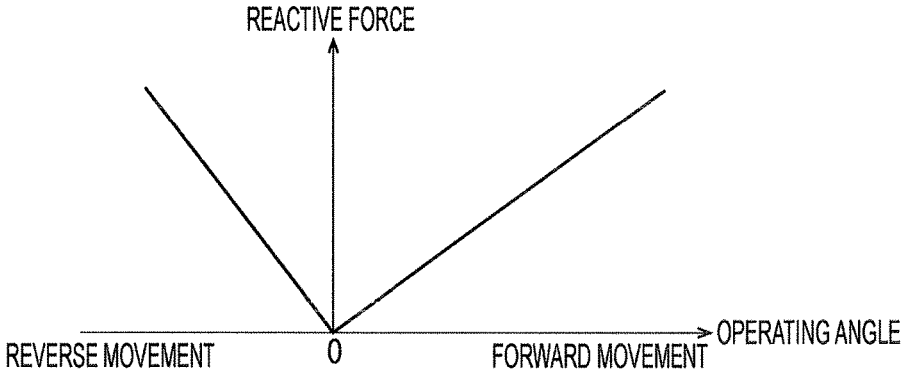
FIG. 7 is a drawing illustrating a property of reactive force according to an operating angle of an operating lever.

FIG. 7 is a drawing illustrating a characteristic line of the reactive force against the operating direction and the operating angle (the lever position) of the operating lever 71. FIG. 7 illustrates the operating angle of the operating lever 71 on the horizontal axis and the reactive force on the vertical axis. The position indicated by "0" on the horizontal axis is the neutral position. The use of the characteristic line in FIG. 7 in the range (the range in which the shift is operated) from the position of Pf1 to the position of Pr1 illustrated in FIG. 5A ensures obtaining feeling of moderation of the operating lever 71 at the neutral position.

In FIG. 7, the reactive force increases proportionate to the increase in operating angle from "0" to the forward movement side. The reactive force increases proportionate to the increase in operating angle from "0" to the reverse movement side. Here, a gradient of the characteristic line on the forward movement side differs from a gradient of the characteristic line on the reverse movement side, and the gradient on the reverse movement side is larger than the gradient on the forward movement side. Accordingly, the operating lever 71 becomes heavy in the turning to the shift position Pr1 side in the reverse movement compared with the turning of the operating lever 71 from the neutral position indicated by "0" to the shift position Pf1 side in the forward movement. When the operating lever 71 is turned to the neutral position indicated by "0," the reactive force gradually decreases.

Figure 8:
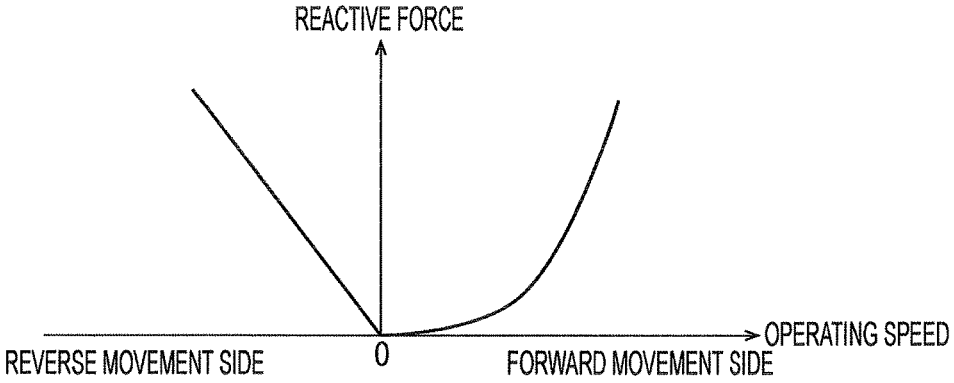
FIG. 8 is a drawing illustrating the property of the reactive force according to an operating speed of the operating lever.

FIG. 8 is a drawing illustrating a characteristic line of the reactive force against the operating direction and the operating speed of the operating lever 71. FIG. 8 illustrates the operating speed of the operating lever 71 on the horizontal axis and the reactive force on the vertical axis. The position indicated by "0" on the horizontal axis means that the operating speed is 0.

In FIG. 8, an excess of a specific operating speed from "0" to the forward movement side suddenly increases the reactive force. Further, the reactive force increases proportionate to increase in operating speed from "0" to the reverse movement side. Accordingly, the operating lever 71 becomes heavy if the sudden, unintended operation occurs from the position indicated by "0" to the forward movement side. When the operating speed is slow like fine adjustment of the propulsion, the reactive force is decreased to ensure lightly operating the operating lever 71 and to facilitate the fine turning.

To turn the operating lever 71 to the neutral position (turning to the deceleration side), by making the reactive force constant and using the characteristic line in FIG. 7 without the use of the characteristic line in FIG. 8 allows easily turning the operating lever 71.

Figure 9:
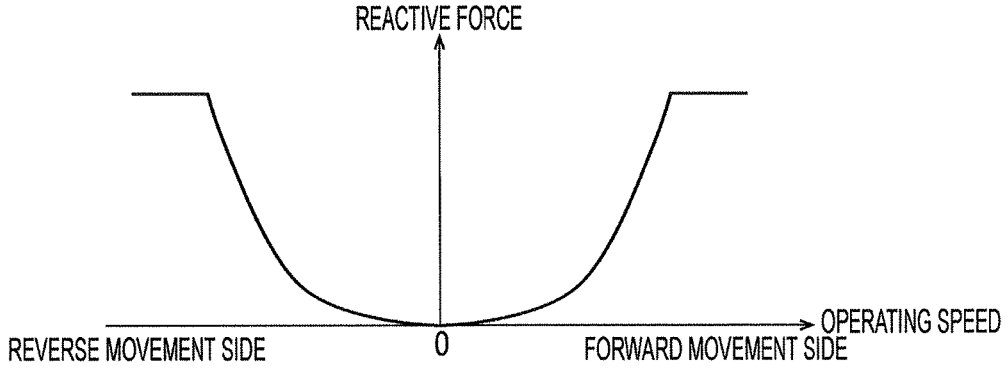
FIG. 9 is a drawing illustrating a property of reactive force of another example according to an operating speed of an operating lever.

FIG. 9 is a drawing illustrating another example showing a characteristic line of reactive force against the operating direction and the operating speed of the operating lever 71. FIG. 9 illustrates the operating speed of the operating lever 71 on the horizontal axis and the reactive force on the vertical axis. The position indicated by "0" on the horizontal axis means that the operating speed is 0.

In FIG. 9, an excess of a specific operating speed from "0" to the forward movement side and the reverse movement side suddenly increases the reactive force. Further, additional excess of a predetermined operating speed makes the reactive force constant. Accordingly, for example, when the sudden operation is required to avoid danger, applying a force exceeding the reactive force allows operating the operating lever 71.

To turn the operating lever 71 to the neutral position (turning to the deceleration side), by making the reactive force constant and using the characteristic line in FIG. 7 without the use of the characteristic line in FIG. 9 allows easily turning the operating lever 71.

The memory 74 in the control unit 72 stores a program so as to generate the reactive force according to the characteristic lines in FIG. 7 to FIG. 9. Accordingly, changing the program stored in the memory 74 allows the control unit 72 to change the property of the reactive force given against the operation of the operating lever 71. For example, the property may be changed to a property produced by combination of the characteristic lines in FIG. 7 to FIG. 9. When the control unit 72 performs control such that the reactive force is given against the operation of the operating lever 71 based on the operating state of the operating lever 71, in the case where the information of the shift position is required, the information of the shift position can be obtained from the control unit 40 in the outboard motor 10 or via the BCM 61. Alternatively, the control unit 72 can obtain the information of the shift position from the lever position sensor 77 or the motor unit 76.

Thus, the remote control system 60 of the outboard motor 10 includes the control unit 72 to control the reactive force given by the motor unit 76. By controlling the reactive force given against the operation of the operating lever 71 by the control unit 72, the reactive force against the operation of the operating lever 71 can be freely adjusted.

In this example, the control unit 72 controls the reactive force given by the motor unit 76 based on the operating state of the operating lever 71. Accordingly, the boat operator can obtain operational feeling according to the operating state while operating the operating lever 71.

The control unit 72 controls the reactive force given by the motor unit 76 based on the operating direction of the operating lever 71 and at least any one of the operating angle and the operating speed of the operating lever 71 as the operating state of the operating lever 71.

For example, the control unit 72 performs the control such that the reactive force increases against the operation of the operating lever 71 as the operating angle (the lever position) from the predetermined position (the neutral position) of the operating lever 71 increases. Accordingly, the boat operator can obtain the operational feeling like when the remote control system 60 is coupled to the outboard motor 10 with a cable.

For example, the control unit 72 performs the control such that the reactive force increases against the operation of the operating lever 71 as the operating speed of the operating lever 71 increases. Accordingly, when a third person purposely or unintentionally operates the operating lever 71 suddenly and the boat 1 shakes and the operating lever 71 moves by gravitation and inertia force, the control unit 72 gives the reactive force to make the operation heavy, thus ensuring reducing the unintended propulsion of the outboard motor 10.

The remote control system 60 obtains the operating state of the operating lever 71 using the angle detector built into the motor unit 76, not obtaining the operating state of the operating lever 71 from the lever position sensor 77. That is, the control of giving the reactive force against the operation of the operating lever 71 is independent of the control of detecting the position of the operating lever 71 by the lever position sensor 77 and switching the shift position and controlling the propulsion. Accordingly, even if the motor unit 76 has a fault, this only gives the reactive force against the operation of the operating lever 71 and therefore the operation of the outboard motor 10 can be unaffected.

Since the remote control device 70 includes the control unit 72, the control to give the reactive force against the operation of the operating lever 71 can be completed in the remote control device 70. This eliminates the need for coupling the remote control device 70 to a control unit separately installed outside the remote control device 70, ensuring improving ease of handling of the remote control device 70. Note that the remote control device 70 does not need to include the control unit 72. For example, a control unit included in the BCM 61 and the control unit 40 in the outboard motor 10 may perform the control to give the reactive force against the operation of the operating lever 71.

When the motor unit 76 gives the reactive force against the operation of the operating lever 71, the turning from the motor unit 76 is decelerated by the reduction gear 86 or a similar device and is transmitted to the operating lever 71; therefore, the motor unit 76 can be configured small. Accordingly, the remote control device 70 can be downsized.

Second Example

The second example describes the case of the control unit 72 controlling the reactive force given against the operation of the operating lever 71 based on the operating state of the outboard motor 10.

The control unit 72 in the remote control device 70 can obtain the operating state of the outboard motor 10 directly from the control unit 40 in the outboard motor 10 or via the BCM 61. Here, the operating state of the outboard motor 10 includes the rotation speed of the engine 12 and at least one of the throttle position of the throttle valve 53 and the shift position of the shift device 30. The control unit 72 may obtain the information of the shift position of the shift device 30 directly from the lever position sensor 77.

The control unit 72 can perform the control such that the reactive force given against the operation of the operating lever 71 increases as the throttle position of the throttle valve 53 becomes large.

The control unit 72 can perform the control such that the reactive force given against the operation of the operating lever 71 increases as the rotation speed of the engine 12 becomes large.

The control unit 72 can obtain the information of the shift position of the shift device 30 and perform the control such that the reactive force given against the operation of the operating lever 71 increases as the operating lever 71 approaches the acceleration side and the reactive force given against the operation of the operating lever 71 decreases as the operating lever 71 approaches the deceleration side. Additionally, the control unit 72 can obtain the information of the shift position and perform the control such that the reactive force is given against the operation of the operating lever 71 when the shift position becomes the reverse movement from the forward movement exceeding the neutral position. On the other hand, the control unit 72 can obtain the information of the shift position and perform the control such that the reactive force when the shift position becomes the forward movement from the reverse movement exceeding the neutral position smaller than the reactive force when the shift position becomes the reverse movement exceeding the neutral position is given or the reactive force is not given.

In this example, the control unit 72 controls the reactive force given by the motor unit 76 based on the operating state of the outboard motor 10. Accordingly, the boat operator can recognize the operating state of the outboard motor 10 while operating the operating lever 71.

Further, the control unit 72 controls the reactive force given by the motor unit 76 based on the rotation speed of the engine 12 and at least any one of the throttle position of the throttle valve 53 and the shift position of the shift device 30 as the operating state of the outboard motor 10.

For example, the control unit 72 performs the control such that the reactive force given against the operation of the operating lever 71 increases as the throttle position of the throttle valve 53 becomes large. In this case, the boat operator can recognize the throttle position of the throttle valve 53 while operating the operating lever 71.

For example, the control unit 72 performs the control such that the reactive force given against the operation of the operating lever 71 increases as the rotation speed of the engine 12 becomes large. In this case, the boat operator can recognize the rotation speed of the engine 12 while operating the operating lever 71.

The control unit 72 preferably gives the reactive force based on the operating state of the outboard motor 10 in addition to the operating state of the operating lever 71 described in the first example.

Third Example

The first example describes the case of the control unit 72 obtaining the operating state of the operating lever 71 using the angle detector built into the motor unit 76. This example describes the case of the control unit 72 obtaining the operating state of the operating lever 71 using the lever position sensor 77.

Figure 10:
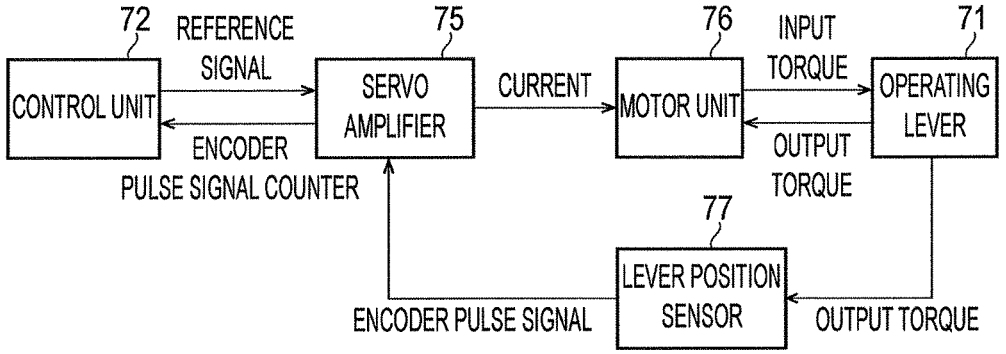
FIG. 10 is a drawing illustrating a flow of control by the remote control device.

FIG. 10 is a drawing illustrating one example of a flow of control by the remote control device 70.

Similarly to the turning of the operating lever 71 output to the motor unit 76 as the torque, the turning is output to the lever position sensor 77. The lever position sensor 77 uses an encoder to output a pulse signal to the servo amplifier 75. The servo amplifier 75 uses the built-in encoder to count the pulse signal and outputs the counted signal or similar data to the control unit 72. The control unit 72 calculates the operating direction of the operating lever 71 and at least any one of the operating angle (the lever position) and the operating speed based on the counted signal or similar data to obtain the operating state of the operating lever 71. Afterwards, the flow that the reactive force is given from the control unit 72 against the operation of the operating lever 71 through the servo amplifier 75 and the motor unit 76 is similar to the first example.

The control unit 72 thus obtains the rating state of the operating lever 11 using the lever position sensor 77, and this eliminates the need for the motor unit 76 including the angle detector, thereby ensuring the use of the simplified motor unit 76.

While the examples according to the present invention have been described above, the present invention is not limited to only the above-described examples but changes and a similar modification are possible within the scope of the present invention and the respective examples may be combined as necessary.

While the above-described examples describe the case of the boat propulsion device being the outboard motor 10 using the engine 12, the configuration is not limited to this, and the boat propulsion device can be any device capable of propelling the boat 1.

While the above-described examples describe the case of the reactive force giving unit being the motor unit 76, the configuration is not limited to this. The reactive force giving unit may also be a swing damper that can give the reactive force according to the operating direction and the operating speed of the operating lever 71. The swing damper gives the reactive force by a flow resistance when hydraulic fluid sealed the inside passes through an orifice hole. The flow resistance can change the property of the reactive force by changing a passage area of the orifice hole.

While the above-described examples describe the case of the remote control device 70 including the one operating lever 71, this should not be construed in a limiting sense.

The two operating levers 71 may be provided such that the respective different outboard motors 10 can be operated. With the remote control device 70 including the two operating levers 71, it can be configured such that the one motor unit 76 is provided for the one operating lever 71.

The present invention ensures freely adjusting the magnitude of the reactive force against the operation of the operating lever.

What is claimed is:

1. A remote control system of boat propulsion device configured to operate a shift device that switches between forward and reverse movements of the boat propulsion device through communications with the boat propulsion device, the remote control system comprising:

an operating lever operated by a boat operator;

a reactive force giving unit configured to generate a reactive force against an operating direction of the operating lever to give the reactive force against the operation of the operating lever; and a control unit configured to control the reactive force given by the reactive force giving unit, wherein the reactive force giving unit is configured to give the reactive force against the operation of the operating lever according to the operating direction of the operating lever and at least any one of an operating speed and a lever position of the operating lever.

2. The remote control system of boat propulsion device according to claim 1, wherein the control unit is configured to control the reactive force given by the reactive force giving unit based on an operating state of the boat propulsion device.

3. The remote control system of boat propulsion device according to claim 2, wherein the control unit is configured to control the reactive force given by the reactive force giving unit based on a rotation speed of an engine and at least any one of a throttle position of a throttle valve and a shift position of the shift device as the operating state of the boat propulsion device.

4. The remote control system of boat propulsion device according to claim 1, wherein the operating direction of the operating lever includes a front side or a rear side.

5. The remote control system of boat propulsion device according to claim 1, wherein the operating lever is operable to change propulsion of the boat propulsion device.

6. The remote control system of boat propulsion device according to claim 1, wherein the control unit performs control such that the reactive force increases as the operating lever recedes from a neutral position.

7. The remote control system of boat propulsion device according to claim 1, wherein the control unit performs control such that the reactive force decreases as the operating lever approaches the neutral position.

8. The remote control system of boat propulsion device according to claim 1, wherein the control unit performs control such that the reactive force increases as the operating speed of the operating lever increases.

9. The remote control system of boat propulsion device according to claim 8, wherein the control unit performs control such that the reactive force increases when the operating speed of the operating lever exceeds a predetermined level.

10. The remote control system of boat propulsion device according to claim 8, wherein the control unit performs control such that the reactive force becomes constant when the operating speed of the operating lever exceeds a predetermined level.

* * * * *